US007986911B2

(12) United States Patent
Palumbo et al.

(10) Patent No.: US 7,986,911 B2
(45) Date of Patent: Jul. 26, 2011

(54) ARCHITECTURE FOR A MEDIA FEEDING OPTION FOR AN IMAGE FORMING DEVICE

(75) Inventors: Franklin Joseph Palumbo, Nicholasville, KY (US); Paul Douglas Horrall, Lexington, KY (US); Luis Banguis Jimenez, Lapu-Lapu (PH)

(73) Assignee: Lexmark International, Inc., Lexington, KY (US)

( * ) Notice: Subject to any disclaimer, the term of this patent is extended or adjusted under 35 U.S.C. 154(b) by 678 days.

(21) Appl. No.: 11/692,211

(22) Filed: Mar. 28, 2007

(65) Prior Publication Data

US 2008/0240819 A1 Oct. 2, 2008

(51) Int. Cl.
*G03G 15/00* (2006.01)

(52) U.S. Cl. ..... 399/392; 399/391; 399/393; 400/691; 400/693

(58) Field of Classification Search ..... 399/392, 399/391, 388, 393; 347/104; 271/9.01, 9.09; 400/691–693

See application file for complete search history.

(56) References Cited

U.S. PATENT DOCUMENTS 4,009,958 A 3/1977 Kurita et al.
4,386,838 A 6/1983 Hirabayashi et al.
4,432,632 A 2/1984 Yokota
4,585,329 A 4/1986 Landa
4,615,605 A 10/1986 Kida et al.
4,639,119 A 1/1987 Isaka
4,657,372 A 4/1987 Ikeda et al.
4,678,318 A 7/1987 Bisaiji
4,692,018 A 9/1987 Tamura
4,757,344 A 7/1988 Idenawa et al.
4,761,667 A 8/1988 Miyai et al.
4,791,454 A 12/1988 Takahashi et al.
4,862,212 A 8/1989 Tanzawa et al.
4,866,482 A 9/1989 Hirasawa et al.
4,873,548 A 10/1989 Kobayashi et al.
4,901,110 A 2/1990 Tompkins et al.
4,924,267 A 5/1990 Yoshikawa et al.
4,926,219 A 5/1990 Hirasawa et al.
4,943,828 A 7/1990 Manabe et al.
4,987,446 A 1/1991 Mochimaru et al.
5,027,158 A 6/1991 Tompkins et al.
5,061,959 A 10/1991 Kinoshita et al.
5,153,640 A 10/1992 Okabe
5,160,963 A 11/1992 Haneda et al.
5,160,964 A 11/1992 Takahashi et al.
5,170,209 A 12/1992 Tompkins et al.
5,189,471 A 2/1993 Irihara et al.

(Continued)

*Primary Examiner* — Matthew G Marini
(74) *Attorney, Agent, or Firm* — Justin M. Tromp; John Victor Pezdek

(57) ABSTRACT

The present application is directed to image forming devices with option trays to introduce media into a media path. One embodiment include the image forming device having a body with a front, back, top, and bottom sides. The sides may form an interior space to contain an imaging unit. The imaging unit may include elements for producing toner images. A media path may extend in a substantially vertical orientation within the interior space. An integrated tray may be positioned at the bottom side of the body and include a first input tray and a manual feed inlet on the front side of the body. Each of first input tray and manual feed inlet form sections of the media path. An option tray may be operatively connected to the bottom side of the body, and may include a second input tray and a multi-purpose feeder. The option tray further lengthens the media path and provides additional avenues to introduce media sheets into the media path.

18 Claims, 3 Drawing Sheets

U.S. PATENT DOCUMENTS 5,266,998 A 11/1993 Lee
5,276,479 A 1/1994 Inomata
5,294,960 A 3/1994 Nomura et al.
5,309,211 A 5/1994 Yoshioka
5,323,210 A 6/1994 Inomata
5,367,363 A 11/1994 Kai et al.
5,371,575 A 12/1994 Sekino et al.
5,402,212 A 3/1995 Ito et al.
5,440,373 A 8/1995 Deki et al.
5,442,421 A 8/1995 Kojima
5,452,064 A 9/1995 Inomata
5,528,343 A 6/1996 Tada et al.
5,537,187 A 7/1996 Sekine
5,585,889 A 12/1996 Shishido et al.
5,604,570 A 2/1997 Jeran et al.
5,646,720 A 7/1997 Song
5,666,599 A 9/1997 Miyasaka et al.
5,682,579 A 10/1997 Nomura et al.
5,699,091 A 12/1997 Bullock et al.
5,742,319 A 4/1998 Fukunaga et al.
5,787,324 A 7/1998 Iwasaki
5,802,432 A 9/1998 Coffey et al.
5,815,664 A 9/1998 Asano
5,815,775 A 9/1998 Miyasaka et al.
5,907,749 A 5/1999 Nomura et al.
5,920,752 A 7/1999 Karakama et al.
5,953,559 A 9/1999 Obu
5,966,566 A 10/1999 Odagawa et al.
6,085,051 A 7/2000 Miyasaka et al.
6,118,961 A 9/2000 Nomura et al.
6,163,666 A 12/2000 Hosokawa et al.
6,347,204 B1 2/2002 Kurosawa
6,377,765 B1 4/2002 Shishido et al.
6,381,428 B1 4/2002 Yamamoto et al.
6,384,940 B1 5/2002 Kawai et al.
6,445,895 B2 9/2002 Shirasawa et al.
6,484,003 B2 * 11/2002 Tokutake et al. ..... 399/110
6,501,925 B2 12/2002 Yamamoto et al.
6,697,586 B2 2/2004 Yamamoto et al.
6,798,430 B2 9/2004 Sato
7,292,820 B2 * 11/2007 Triplett et al. ..... 399/393
7,761,046 B2 * 7/2010 Hiramoto et al. ..... 399/393
2003/0025263 A1 * 2/2003 Koga ..... 271/9.12
2006/0133875 A1 * 6/2006 Okada et al. ..... 399/392

* cited by examiner

ARCHITECTURE FOR A MEDIA FEEDING OPTION FOR AN IMAGE FORMING DEVICE

BACKGROUND

The present application is directed to image forming devices and, more specifically, to feed options for introducing and moving media sheets into the image forming devices.

Image forming devices function by moving media sheets along a media path. The timing of the media sheets along the media path is carefully orchestrated to coincide with formation of a toner image. The media sheets and toner images meet at a transfer area where the toner image is applied to the media sheet.

Image forming devices typically include multiple input sources to introduce the media sheets into the media path. The input sources may accommodate a range of media types, and a range of media sheet quantities from a single media sheet to large quantities such as 2,000+ sheets. One type of input source is referred to as a multi-purpose feeder that usually accommodates a low number of sheets. Multi-purpose feeders are often designed to feed specialty media sheets that are difficult to feed through normal input trays, such as envelopes, transparencies, and cardstock.

A multi-purpose feeder provides many advantages to the image forming device, but there may also be some drawbacks. One drawback is the need for additional hardware to move the media sheets from the multi-purpose feeder and into the media path. This additional equipment, may result in the image forming device including a larger overall size. This is a negative because many users want a small device that can easily fit within their workspace. Further, the equipment adds cost to the image forming device which is another negative as price is a leading driver for purchasing decisions.

SUMMARY

The present application is directed to image forming devices with option trays to introduce media into a media path. One embodiment include the image forming device having a body with a front, back, top, and bottom sides. The sides may form an interior space to contain an imaging unit. The imaging unit may include elements for producing toner images. A media path in a first section extends in a substantially vertical orientation within the interior space from an output area at the top of the body through the imaging unit. An integrated tray may be positioned at the bottom side of the body and include a first input tray and a manual feed inlet on the front side of the body. Each of first input tray and manual feed inlet form a second section of the media path. An option tray may be placed below the bottom side of the body of the imaging unit and is operatively connected to the integrated tray within the body, and may include a second input tray and a multi-purpose feeder. The option tray provides an extension section of the media path outside of the body that connects to the second section of the media path within the body and further lengthens the media path and provides additional avenues to introduce media sheets into the media path.

DETAILED DESCRIPTION

Figure 1:
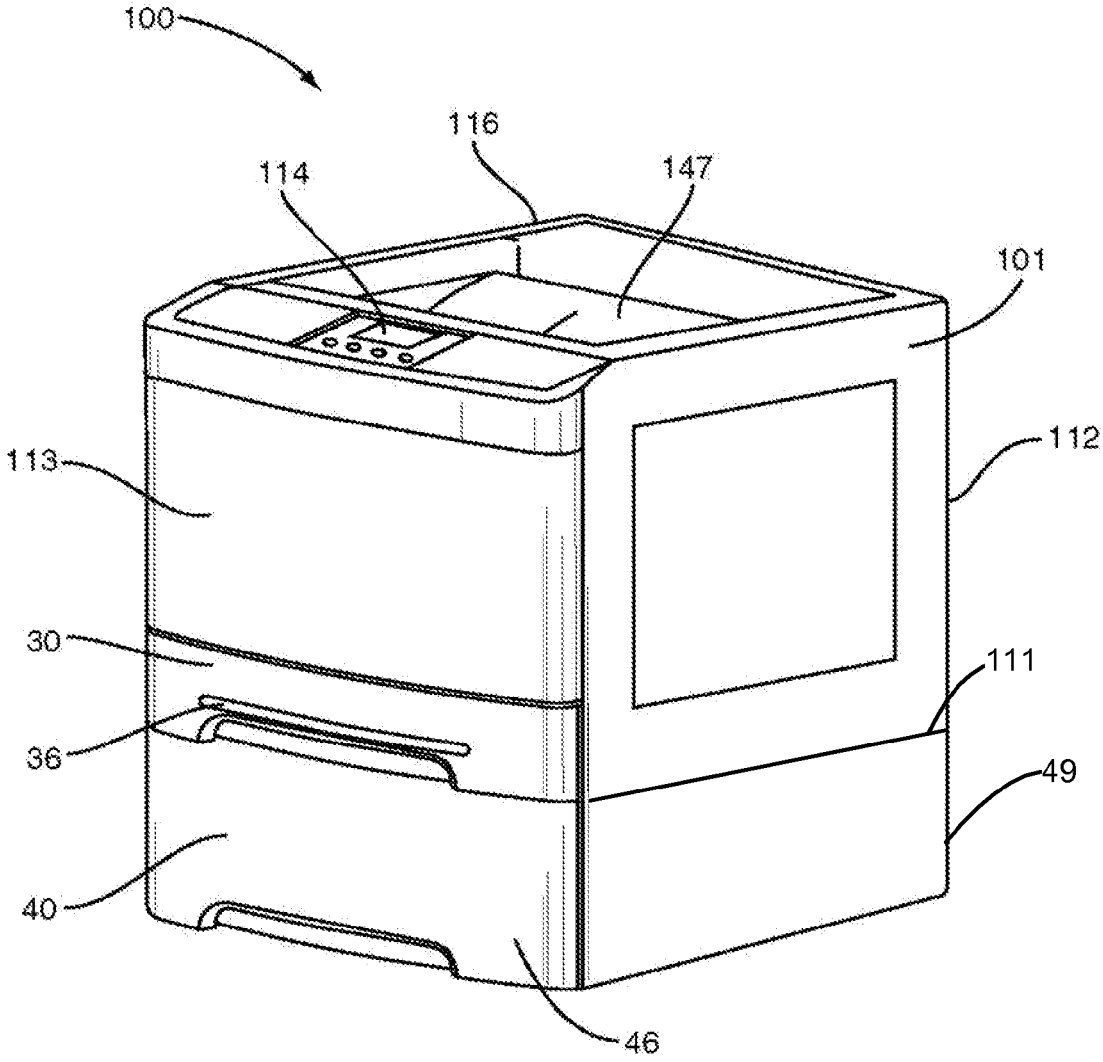
FIG. 1 is a perspective view of an image forming device according to one embodiment.

The present application is directed to architectures for image forming devices. These architectures include multiple inputs for a user to input media sheets into a media path. The inputs may accommodate various quantities and types of media sheets. FIG. 1 illustrates one embodiment of an image forming device 100. The device 100 includes an integrated input tray 30 positioned in a lower section of a body 101. The tray 30 is sized to contain a stack of media sheets that will receive color and/or monochrome images. The media input tray 30 is preferably removable for refilling. An option tray 40 may also be operatively connected to the body 101 to input additional media sheets. Option tray 40 may include one or more input options for introducing the media sheets.

Figure 2:
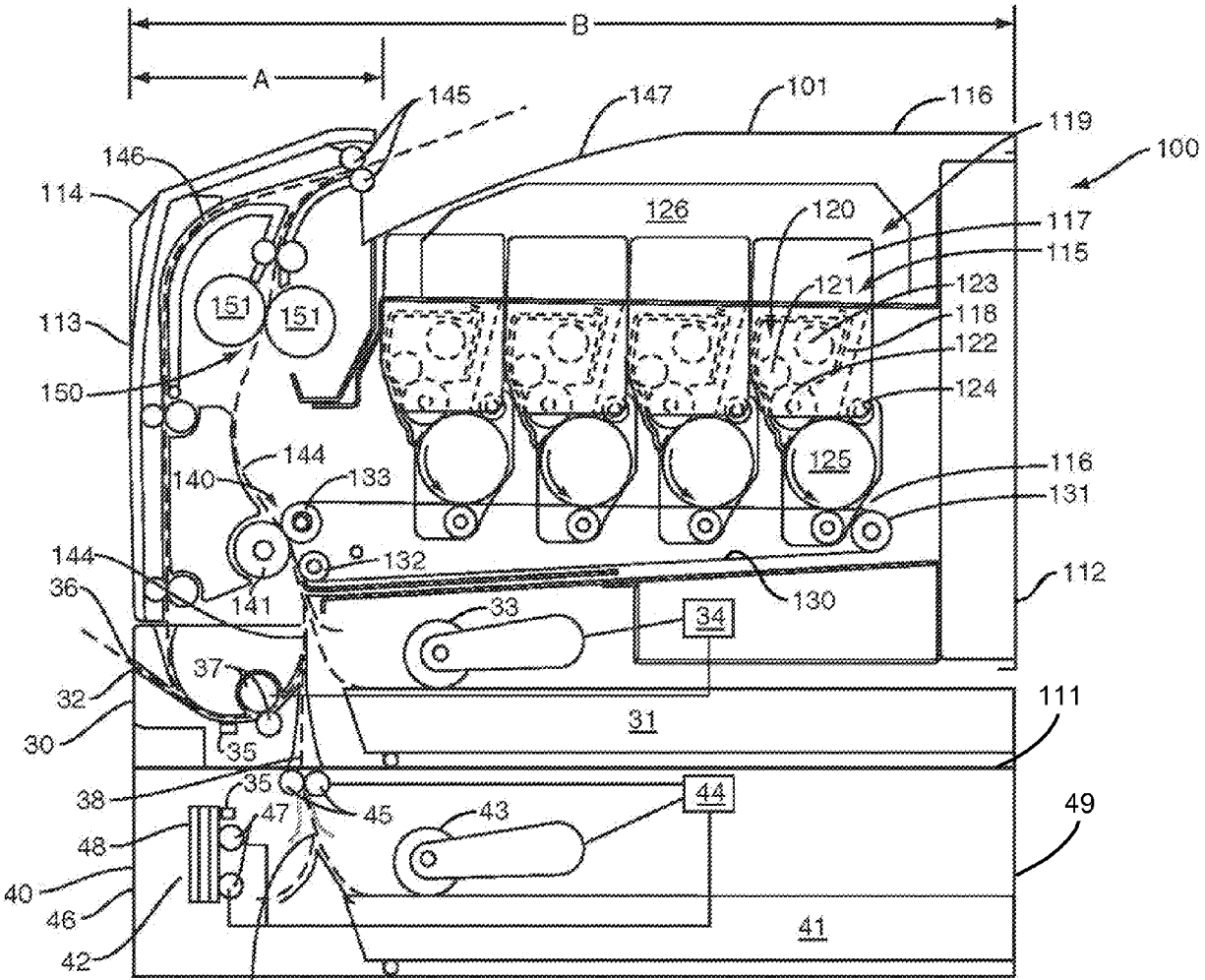
FIG. 2 is a schematic side view of an image forming device with an option tray door in a closed position according to one embodiment.

FIG. 2 illustrates the image forming device 100 that includes the integrated input tray 30 and the option tray 40. Media sheets are introduced from one of these trays 30, 40 and moved along a media path 144 during the image formation process. A control panel 114 may be located on the front 113 of the body 101. Using the control panel 114, the user is able to enter commands and generally control the operation of the image-forming device 100. For example, the user may enter commands to switch modes (e.g., color mode, monochrome mode), view the number of images printed, take the device 100 on/off line to perform periodic maintenance, and the like.

A first toner transfer area 120 includes an imaging unit with one or more imaging stations 119. The imaging stations 119 are aligned horizontally extending from the front side 113 to the back side 112 of the body 101. Each imaging station 115 includes a developer unit 118, a photoconductor unit 116, and a toner cartridge 117. Each of the imaging stations 119 is mounted such that photoconductive (PC) drums 125 are substantially parallel. For purposes of clarity, the units 118, 116, and cartridge 117 are labeled on only one of the imaging stations 119. In one embodiment, each of the imaging stations 119 is substantially the same except for the color of toner.

The developer unit 118 includes a toner reservoir 120 to contain the toner, a toner adder roll 121, and a developer roll 122. An agitating member 123 may also be positioned within the reservoir 120 to move the toner. The photoconductor unit 116 includes a charging roll 124 and a PC drum 125. The charging roll 124 forms a nip with the PC drum 125, and charges the surface of the PC drum 125 to a specified voltage such as −1000 volts, for example. A laser beam from a printhead 126 is directed to the surface of the PC drum 125 and discharges those areas it contacts to form a latent image. In one embodiment, areas on the PC drum 125 illuminated by the laser beam are discharged to approximately −300 volts. The developer roll 122, which also forms a nip with the PC drum 125, then transfers toner to the PC drum 125 to form a toner image. The toner is attracted to the areas of the PC drum 125 surface discharged by the laser beam from the printhead 126.

An intermediate transfer mechanism (ITM) 130 is disposed adjacent to each of the imaging stations 119. In this embodiment, the ITM 130 is formed as an endless belt trained about a drive roll 131, tension roll 132 and back-up roll 133. During image forming operations, the ITM 130 moves past the imaging stations 119 in a clockwise direction as viewed in FIG. 2. One or more of the PC drums 125 apply toner images in their respective colors to the ITM 130. In one embodiment, a positive voltage field attracts the toner image from the PC drums 125 to the surface of the moving ITM 130.

The ITM 130 rotates and collects the one or more toner images from the imaging stations 119 and then conveys the toner images to a media sheet at a second transfer area. The second transfer area includes a second transfer nip 140 formed between the back-up roll 133 and a second transfer roll 141.

A media path 144 extends through the device 100 for moving the media sheets through the imaging process. A media sheet is initially introduced into the media path 144 at the integrated tray 30 or the option tray 40. The integrated tray 30 includes a first input tray 31 and a manual feed 32. The option tray 40 includes a second input tray 41 and a multi-purpose feeder 42. The media sheet is introduced into the media path 144 and receives the toner image from the ITM 130 as it moves through the second transfer nip 140. The media sheets with toner images are then moved further along the media path 144 and into a fuser area 150. Fuser area 150 includes fusing rolls or belts 151 that form a nip to adhere the toner image to the media sheet. The fused media sheets then pass through exit rolls 145 that are located downstream from the fuser area 150. Exit rolls 145 may be rotated in either forward or reverse directions. In a forward direction, the exit rolls 145 move the media sheet to an output area 147. In a reverse direction, the exit rolls 145 move the media sheet into a duplex path 146 for image formation on a second side of the media sheet. The media path 144 has a first section which extends in a substantially vertical orientation within the interior space from an output area 147 at the top of the body 101 through the imaging unit, and a second section that connects to the first section of the media path 144 and which extends between top and bottom sides of the integrated tray 30 and having branches leading to the first input tray 31 and the manual feed 32. Media path 144 may further include an extension section outside the body 101 that connects to the second section of the media path 144 and which extends from the top side and bottom sides of the option tray 40 and branches out to the second input tray 41 and the multi-purpose feeder 42.

A first embodiment of the image forming device 100 includes only the integrated tray 30 and does not include the option tray 40. The integrated tray 30 provides for introducing media sheets in two separate manners; the input tray 31 and manual feed 32. The sheets in the input tray 31 are picked by a pick mechanism 33 and moved info the media path 144. In this embodiment, the pick mechanism 33 includes a roll positioned at the end of a pivoting arm. The roll rotates to move the media sheets from input tray 31 and info the media path 144. In one embodiment, the pick mechanism 33 is positioned in proximity (i.e., less than a length of a media sheet) to the second transfer area with the pick mechanism 33 moving the media sheets directly from the input tray 31 into the second transfer nip 140.

The manual feed 32 includes an opening 36 in a front face of the tray 30. The opening 38 is sized to receive media sheets from the user. Rolls 37 are positioned downstream from the opening 36 to contact and move the media sheets into the media path 144. In one embodiment, a sensor 35 is positioned at the rolls 37 to sense a leading edge of the media sheets and activate the roll 37.

A motor 34 may be associated with the integrated tray 30 to drive the pick mechanism 33 and the rolls 37. In one embodiment, motor 34 operates in a first direction to drive the pick mechanism 33, and operates in a second direction to drive the roll 37. The motor 34 may be mounted to the integrated tray 30, or may be mounted within the body 101 and operatively connected when the integrated tray 30 is placed within the body 101. The integrated tray 30 is removable from the body 101 through the front side 113. Removal of the tray provides for the user to refill the input tray 31.

An inlet 38 may be positioned on a bottom side of the integrated tray 30. The inlet 38 is an extension of the media path 144 and provides a conduit for receiving media sheets introduced through the option tray 40.

As illustrated in FIG. 1 the bottom side 111 of body 101 is placed on the top side of option tray 40. The option tray 40 is positioned within an option housing 49. The bottom side 111 of body 101 is positioned on top of option housing 49. The option tray 40 includes a second input tray 41 sized to contain a stack of media sheets. In one embodiment, the second input tray 41 includes a greater capacity than input tray 31. In one embodiment, the second input tray 41 may be sized to contain up to about 550 media sheets in a stacked orientation. The option tray 40 is removable from the option tray housing 49 to allow a user to refill the second input tray 41. The sheets in the second input tray 41 are picked by a pick mechanism 43 and moved into the media path 144. The pick mechanism 43 in the second input tray 41 also includes a roll positioned at the end of a pivoting arm.

Rolls 45 are positioned along the media path 144 within the option tray 40. The rolls 45 receive the media sheet from the pick mechanism 43 and move it further along the media path 144. In one embodiment, rolls 45 are positioned in proximity (i.e., less than a length of a media sheet) to the second transfer area. Rolls 45 move the media sheets directly from the second input tray 41 into the second transfer nip 140.

Figure 3:
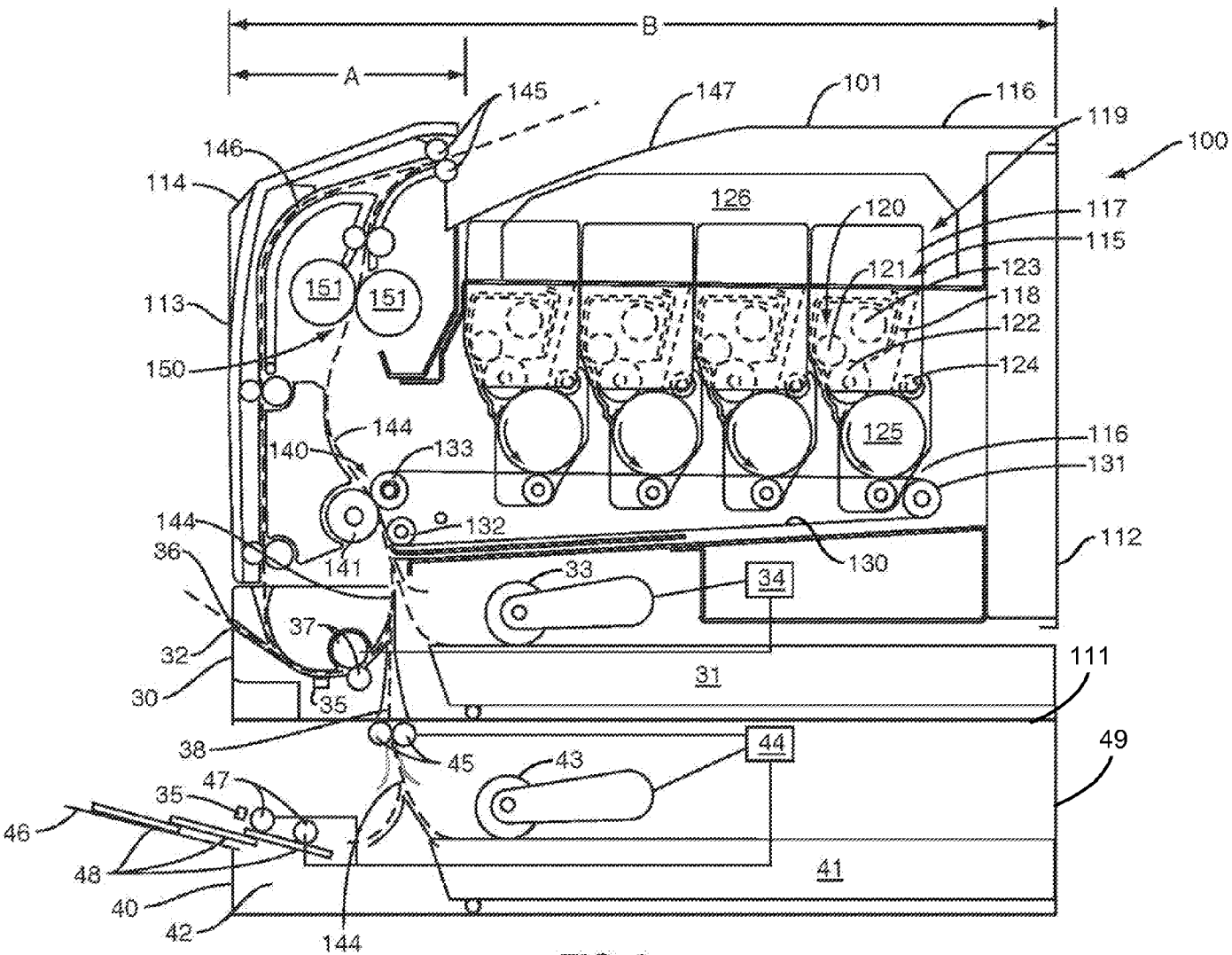
FIG. 3 is a schematic side view of an image forming device with an option tray door in an open position according to one embodiment.

Option tray 40 also includes a multi-purpose feeder 42. Feeder 42 includes one or more rolls 47 and supports 48. The feeder 42 may be selectively positionable between a closed orientation as illustrated in FIG. 2 and an open orientation illustrated in FIG. 3. In the closed position, a door 46 that forms an outer face of the option tray 40 is substantially aligned with the front side 113 of the body 101. Further, supports 48 may be positioned in an overlapping arrangement with the rolls 47 being vertical or substantially vertical. This orientation reduces the overall size and provides for placement within the option tray 40. In the open orientation, the door 46 pivots outward from a lower edge away from the front side 113. Supports 48 spread apart to form a base for supporting the media sheets. Supports 48 may include a length in the open position that is able to support a stack of media sheets such that the user is not required to individually input each sheet. Further, rolls 47 align with the supports 48 and are positioned to move the media sheets into the media path 144. In one embodiment, a sensor 35 is positioned adjacent to the rolls 47 to sense a leading edge of a media sheet. As shown in FIG. 2, a motor 44 may be positioned within option housing 49 to drive pick mechanism 43 and multi-purpose feeder 42. In one embodiment, motor 44 operates in a first direction to drive the pick mechanism 43, and operates in a second direction to drive the roll 47 of multi-purpose feeder 42.

As illustrated in FIG. 2, the media path 144 includes a substantially vertical orientation. The media path 144 extends through the option tray 40, the integrated tray 30, and along the front of the imaging stations 119. In one embodiment, the media path 144 is positioned in proximity to the front side 113. As illustrated in FIG. 2, the media path 144 is positioned a distance A from the front side 113. In one embodiment, the body 101 includes an overall width B extending between the front and back sides 113, 112 and the media path 144 is within a first one-third of the body 101 (i.e., distance A is less than or equal to one-third of distance B). In another embodiment, the media path 144 is within the first one-fourth of the body 101.

The overall architecture of the image forming device 100 is sized to facilitate use within a workspace. The device 100 for the user to perform most functions from the front side 113. This allows the user to positioned the device 100 within their workspace with the back side 112 against a wall or in an otherwise non-accessible orientation. One function performed from the front side 113 includes using the control panel 114 to enter commands and generally control the operation of the image-forming device 100. Functions also include introducing media sheets through the opening 38 in the integrated tray 30, and through the feeder 42 in the option tray 40. Additional functions include removing both the integrated tray 30 and the option tray 40 through the front side to reload the first and second input trays 31, 41.

Terms such as "first", "second", and the like, are also used to describe various elements, regions, sections, etc and are also not intended to be limiting. Like terms refer to like elements throughout the description. As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An image forming device comprising:

a body with front, back, top, and bottom sides that form an interior space to contain an imaging unit comprising a plurality of imaging stations each including at least a toner reservoir, developer roll, photoconductive roll;

a media output area positioned on the top side of the body; a media path extending substantially vertically within the interior space, a first section of the media path extending between the output area and the imaging unit;

an integrated tray for introducing media sheets therefrom and positioned within the body at the bottom side of the body and including a first input tray and a manual feed inlet on the front side of the first input tray, each of first input tray and manual feed inlet forming a second section of the media path with the body that connects to the first section of the media path; and an option tray for introducing media sheets therefrom and positioned within a housing that is removably attached to the bottom side of the body, the option tray operatively connected to the integrated tray and including a second input tray and a multi-purpose feeder, the second input tray and multipurpose feeder forming an extension section to the media path outside of the body that aligns with the second section of the media path in the body when the body is placed on top of the option tray, the multi-purpose feeder including a door that is movable between a closed orientation that aligns with the front side of the body and an open orientation that extends outward from the front side;

wherein substantially the entire media path is positioned within a front one-third of the body in proximity to the front side; and the option tray further includes rolls positioned downstream from the second input tray and the multi-purpose feeder, the rolls positioned a distance from a second transfer area in the body to move the media sheets directly from the option tray, through the integrated tray, and into the second transfer area without receiving an additional driving force between the rolls and the second transfer area.

2. The device of claim 1, wherein a media sheet capacity of the second input tray is greater than a media sheet capacity of the first input tray.

3. The device of claim 1, further comprising a duplex path positioned between the media path and the front side of the body.

4. The device of claim 1, wherein the integrated tray includes an inlet extending through the bottom side of the integrated tray and aligning with the option tray to receive the media sheets from the second input tray and the multi-purpose feeder.

5. The device of claim 1, wherein a motor positioned in the housing of the option tray drives both a pick mechanism in the second input tray and an input roll at the multi-purpose feeder, the motor operating in a first direction to drive the pick mechanism and in a second direction to drive the input roll.

6. The device of claim 5, further including second rolls positioned within the option tray downstream from both the second input tray and the multi-purpose feeder to move media sheets from the option tray and through the integrated tray.

7. The device of claim 1, wherein the integrated tray is removably attached to the body.

8. The device of claim 1, wherein the plurality of imaging stations are arranged substantially horizontally within the interior space.

9. The device of claim 1, wherein the manual feed inlet includes an opening on the front side of the first input tray, a pair of rolls positioned downstream from the opening, and a sensor positioned at the rolls to sense a leading edge of a media sheet and activate the rolls.

10. An image forming device comprising:

a body with front, back, top, and bottom sides with an interior space to contain an imaging unit comprising a plurality of imaging stations each including at least a toner reservoir, developer roll, photoconductive roll;

a media output area positioned on the top side of the body;

a media path extending substantially vertically within the interior space, the media path positioned within the interior space in closer proximity to the front side than the back side, a first section of the media path extending between the output area and the imaging unit;

an integrated tray for introducing media sheets therefrom and removably positioned at the bottom side of the body, the integrated tray including a first input tray, a manual feed and a second section of the media path that extends between top and bottom sides of the integrated tray and connects to the first section of the media path, the second section of the media path further including first and second branches that lead respectively from the first input tray and the manual feed; and an option tray for introducing media sheets therefrom and removably positioned within a housing that is removably attached to the bottom side of the body, the option tray operatively connected to the integrated tray and including a second input tray, a multipurpose feed and an extension section to the media path outside of the body that extends between a top and a bottom of the option tray and aligns with the second section of the media path in the integrated tray, the extension section of the media path further including a third branch that leads from the second input tray and a fourth branch that leads from the multi-purpose feeder, the option tray further including a pair of opposed rolls positioned along the second section of the media path, the rolls positioned a distance from a second transfer area in the body to move the media sheets directly from the option tray, through the integrated tray, and into the second transfer area without receiving an additional driving force between the rolls and the second transfer area.

11. The device of claim 10, wherein the multi-purpose feeder includes a door that is movable between a closed orientation that aligns with the front side of the body and an open orientation that extends outward from the front side.

12. The device of claim 10, further comprising a motor positioned in the housing of the option tray that moves the media sheets from both the second input tray and the multi-purpose feeder, the motor operating in a first direction to move the media sheets from the second input tray and in a second direction to move the media sheets from the multi-purpose feeder.

13. The device of claim 10, wherein substantially the entire media path is positioned within a front quarter of the body in proximity to the front side.

14. An image forming device comprising:

a body with front, back, top, and bottom sides that form an interior space; an output area on the top side of the body; a plurality of imaging stations positioned within the interior space;

an intermediate transfer member positioned adjacent to each of the plurality of imaging stations to receive a toner image from each station at a first transfer area;

a second transfer area positioned along the intermediate transfer member;

a media path extending within the interior space and through the second transfer area, a first section of the media path extending between the output area and the plurality of imaging stations;

a first tray removably attached to a bottom of the body and including a second section of the media path that extends outward from a top of the first tray and aligns with the first section of the media path in the body, the second section of the media path includes a first branch that leads from a first input tray and a second branch that leads from a manual feed, the first tray including a first motor to move media sheets from the first input tray and the manual feed to the second transfer area; and a second tray removably positioned within a housing and operatively connected to the first tray and including an extension section of the media path outside of the body that extends between a top and a bottom of the second tray and outward from a top of the second tray and aligns with the second section of the media path in the first tray, the extension section of the media path further including a third branch that leads from a second input tray and a fourth branch that leads from a multi-purpose feeder, the second tray including a second motor positioned in the housing of the second tray to move media sheets from the second input tray and the multi-purpose feeder to the second transfer area;

wherein the second tray further include includes rolls positioned downstream from the second input tray and the multi-purpose feeder, the rolls being driven by the second motor and positioned to drive the media sheets directly from the second tray into the second transfer area without receiving an additional driving force between the rolls and the second transfer area.

15. The device of claim 14, wherein the first motor operates in a first direction to move the media sheets from the first tray to the second transfer area and in a second direction to move the media sheets from the manual input to the second transfer area.

16. The device of claim 14, wherein the media path, including the first section and the second section, includes a substantially vertical orientation.

17. The device of claim 14, wherein the first tray and the second tray each open from the front side, and further including a control panel positioned at the front side.

18. The device of claim 14, wherein a duplex path is positioned between the front side and the media path and is connected at one end to the first section of the media path adjacent the output area and at its other end to the second branch of the second section of the media path.

* * * * *